US008752298B2

(12) United States Patent
Collins et al.

(10) Patent No.: US 8,752,298 B2
(45) Date of Patent: Jun. 17, 2014

(54) SPRING-ASSISTED FOLDING KNIFE

(76) Inventors: Michael C. Collins, Blanchard, OK (US); Walter W. Collins, North, SC (US); Jane Collins, legal representative, North, SC (US)

( * ) Notice: Subject to any disclaimer, the term of this patent is extended or adjusted under 35 U.S.C. 154(b) by 88 days.

(21) Appl. No.: 13/442,116

(22) Filed: Apr. 9, 2012

(65) Prior Publication Data

US 2013/0263455 A1 Oct. 10, 2013

(51) Int. Cl.
*B26B 1/04* (2006.01)

(52) U.S. Cl.
USPC ..... 30/160; 30/161

(58) Field of Classification Search
USPC ..... 30/158, 159, 160, 161
See application file for complete search history.

(56) References Cited

U.S. PATENT DOCUMENTS

| | | | | | |
|---|---|---|---|---|---|
| 5,111,581 | A * | 5/1992 | Collins | ..... | 30/161 |
| 5,325,588 | A * | 7/1994 | Rogers | ..... | 30/161 |
| 5,769,094 | A * | 6/1998 | Jenkins et al. | ..... | 30/161 |
| 5,822,866 | A * | 10/1998 | Pardue | ..... | 30/161 |
| 6,079,106 | A * | 6/2000 | Vallotton | ..... | 30/161 |
| 6,256,888 | B1 * | 7/2001 | Shuen | ..... | 30/161 |
| 6,941,661 | B2 * | 9/2005 | Frazer | ..... | 30/160 |
| 7,243,430 | B1 * | 7/2007 | Lerch | ..... | 30/160 |
| 7,246,441 | B1 * | 7/2007 | Collins | ..... | 30/160 |
| 8,099,870 | B1 * | 1/2012 | Ralph | ..... | 30/160 |
| 8,499,460 | B1 * | 8/2013 | Pearman | ..... | 30/155 |
| 2003/0070299 | A1 * | 4/2003 | Frazer | ..... | 30/161 |

* cited by examiner

*Primary Examiner* — Hwei C Payer
(74) *Attorney, Agent, or Firm* — Harris Beach PLLC

(57) ABSTRACT

A folding knife includes a lock blade and a handle. The handle includes a transfer bar assembly and a blade opener spring. When the lock blade is closed, a spring working in conjunction with the transfer bar assembly biases the lock blade closed. When the lock blade is opened past a certain point, a blade opening spring assists in moving the lock blade into its open locked position.

12 Claims, 8 Drawing Sheets

SPRING-ASSISTED FOLDING KNIFE

FIELD OF THE INVENTION

This invention relates generally to the field of folding knives, and more particularly to a folding knife with a spring driven opening mechanism.

BACKGROUND OF THE INVENTION

Folding knives are popular due to their compact size and portability. However, a potential drawback of certain folding knives is that they require two hands for use. One hand is required for holding the handle portion of the blade, while the other hand is necessary to withdraw the blade from its retracted position within the handle and move the blade to the extended, operable position.

In most assisted-opening folding knives, a leaf torsion spring or straight wire spring is used, so that when the knife is opened, the spring provides an initial assist to move the blade, but the continued opening of the blade relies on inertia to complete the opening process.

For example, the folding knife disclosed in U.S. Pat. No. 5,815,927 (Collins) allows the user to extract the blade from its refracted position within the handle by the user's engaging and pulling on ridges defined in a rear portion of the blade. A plunger mechanism having a coil spring facilitates opening of the blade, but the user is still required to pull on the ridges in order to move the blade through a selected range of motion and for the spring to assist the blade to move it to the extended position.

Many folding knives have been patented. U.S. Pat. No. 273,858 (Korn) discloses a folding knife having a leaf-type spring for moving a blade to an extended position. U.S. Pat. No. 1,603,914 (Hermann) discloses a folding knife having a coil spring connected to a metal tape, which pulls the blade to a retracted position. U.S. Pat. No. 2,601,999 (Sly) discloses a foldable gaff hook having a similar opening mechanism. U.S. Pat. No. 2,407,897 (Newman) discloses a spring for pivoting blade open upon actuation of a locking lever. U.S. Pat. No. 698,080 (Treas) discloses use of an actuating spring for pivoting a blade to an open position. U.S. Pat. No. 4,535,539 (Friedman, et al.) and U.S. Pat. No. 5,093,995 (Jan) disclose button release mechanisms for folding knives. U.S. Pat. No. 4,893,409 (Poehlmann) and U.S. Pat. No. 5,964,035 (Poehlmann) disclose folding knives having adjustment screws for adjusting the fit of the blade in the extended position. U.S. Pat. No. 1,065,863 (Carter) also discloses use of set, or an adjustment, screw. U.S. Pat. No. 6,397,477 (Collins) discloses a spring-assisted folding knife which initiates pivoting a blade from a retracted position to a locked extended position. These knives typically use either inertia, gravity-assist, or a flick of the wrist to complete the opening process.

SUMMARY OF THE INVENTION

Briefly stated, a folding knife includes a lock blade and a handle. The handle includes a transfer bar assembly and a blade opener spring. When the lock blade is closed, a spring working in conjunction with the transfer bar assembly biases the lock blade closed. When the lock blade is opened past a certain point, a blade opening spring assists in moving the lock blade into its open locked position.

According to an embodiment of the invention, a folding knife includes a lock blade; and a handle connected to the lock blade; wherein the handle includes a transfer bar assembly biased by a compression spring; and a blade opener spring connected to the lock blade; such that when the lock blade is in a closed position, the transfer bar assembly biases the lock blade into the closed position, and such that when the lock blade is opened past a certain point, the blade opener spring assists in moving the lock blade into an open position.

According to an embodiment of the invention, a method of manufacturing a folding knife includes the steps of making a file side handle, a lock side liner, a spline, a mark side liner, a mark side handle, and a lock blade; wherein the lock side liner, the spline, and the mark side liner each contain a transfer bar assembly recess; making a transfer bar assembly by (a) making a front transfer bar, (b) making a rear transfer bar, (c) making a leaf spring, (d) pivotally connecting the front transfer bar to the rear transfer bar, and (e) connecting the leaf spring to the rear transfer bar such that the leaf spring biases the front transfer bar so that the front transfer bar is axially aligned with the rear transfer bar; making a compression spring and a blade opener spring; and assembling the folding knife.

DETAILED DESCRIPTION OF THE PREFERRED EMBODIMENT

Figure 1:
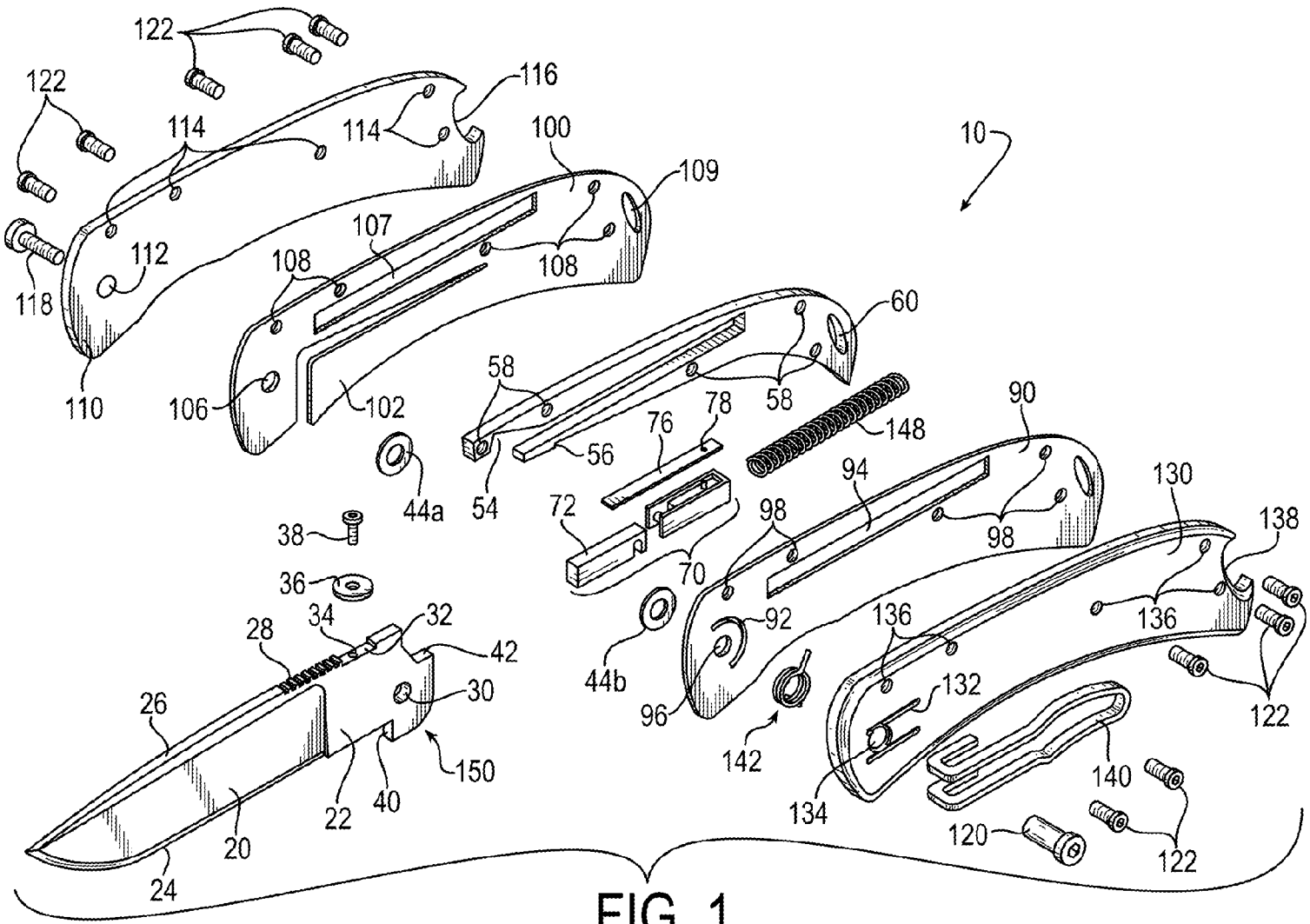
FIG. 1 shows an exploded perspective view of a folding knife according to an embodiment of the invention.
Figure 2:
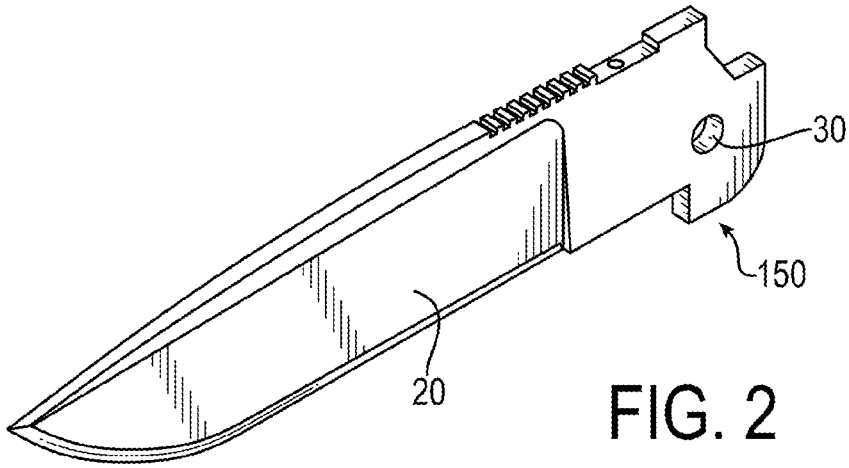
FIG. 2 shows a perspective view of a lock blade according to an embodiment of the invention.

Referring to FIG. 1, a folding knife 10 is shown in its component parts. Referring also to FIG. 2, a lock blade 20, preferably made of 420HC stainless and preferably heat treated to 50-59 HRC, includes an edge 24, a blade spine 26 with a notched area 28 on it, and a tang 22. Blade spine 26 preferably includes a recessed area 32 with a threaded hole 34 centered therein which receives a thumb stud screw 38 which attaches a thumb stud 36 to lock blade 20. Tang 22 includes a hole 30 and a hole 150 which are used in the knife assembly process, a sear 40, and a cutout area 42. Cutout area 42 ensures that lock blade 20 doesn't interfere with the remainder of the knife as it is folded. The purpose of sear 40 will be explained later.

Figure 3:
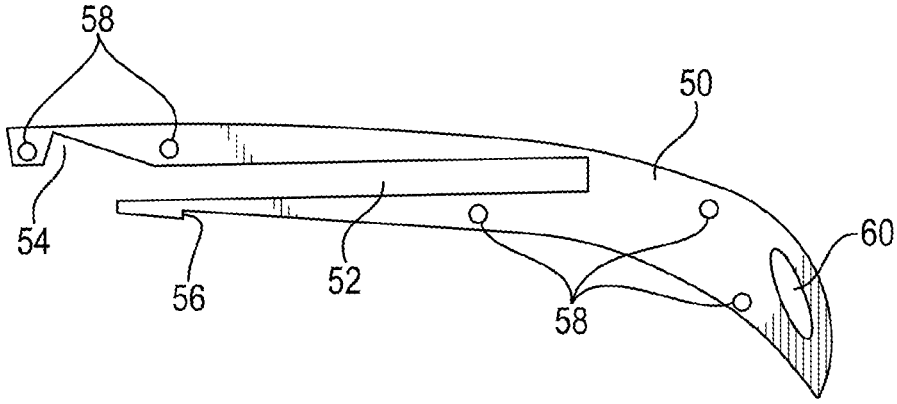
FIG. 3 shows a front elevation view of a spine according to an embodiment of the invention.
Figure 4A:
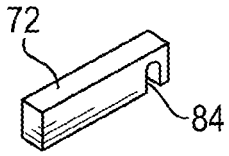
FIG. 4A shows a perspective view of a front transfer bar according to an embodiment of the invention.
Figure 4B:
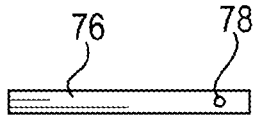
FIG. 4B shows a top view of a leaf spring according to an embodiment of the invention.
Figure 4C:
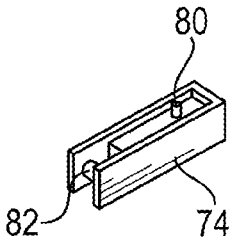
FIG. 4C shows a perspective view of a rear transfer bar according to an embodiment of the invention.
Figure 4D:
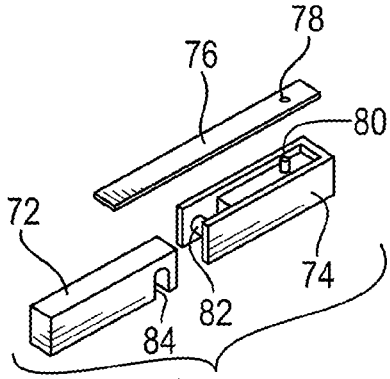
FIG. 4D shows a perspective exploded view of the front transfer bar, rear transfer bar, and leaf spring according to an embodiment of the invention.
Figure 4E:
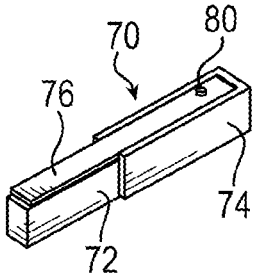
FIG. 4E shows a perspective view of a transfer bar assembly according to an embodiment of the invention.

Referring now to FIGS. 1 and 3, a spine 50 is preferably of 420 stainless and includes a transfer bar assembly recess 52 for receiving a transfer bar assembly 70, a recess 54, a liner lock stop 56, a plurality of threaded holes 58, and a lanyard hole 60.

Referring to FIGS. 1 and 4, transfer bar assembly 70 includes a front transfer bar 72 which includes a hook 84, while a rear transfer bar 74 includes a bar 82. Hook 84 fits over bar 82, thus connecting front transfer bar 72 to rear transfer bar 74 while allowing front transfer bar 72 to pivot with respect to rear transfer bar 74. A leaf spring 76 is connected across front transfer bar 72 and rear transfer bar 74 to keep transfer bar assembly 70 biased in the straight position. Leaf spring 76 is preferably made of stainless steel, while front transfer bar 72 is preferably made of high carbon stainless steel, so leaf spring 76 can be welded to front transfer bar 72. Rear transfer bar 74 is preferably made of a plastic such as DELRIN®, so a stud hole 78 is formed near an end of leaf spring 76 which fits over a stud 80 on rear transfer bar 74. Leaf spring 76 is then connected to rear transfer bar 74 preferably by hot melting stud 80.

Figure 5:
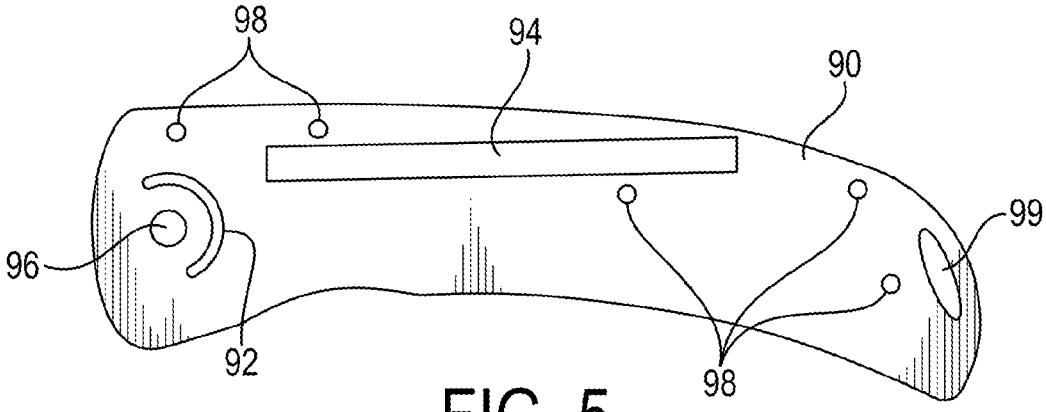
FIG. 5 shows a front elevation view of a mark side liner according to an embodiment of the invention.

Referring to FIGS. 1 and 5, a mark side liner 90 includes a curved slot 92 and a transfer bar assembly recess 94. Mark side liner also includes a hole 96, a plurality of threaded holes 98, and a lanyard hole 99.

Figure 6:
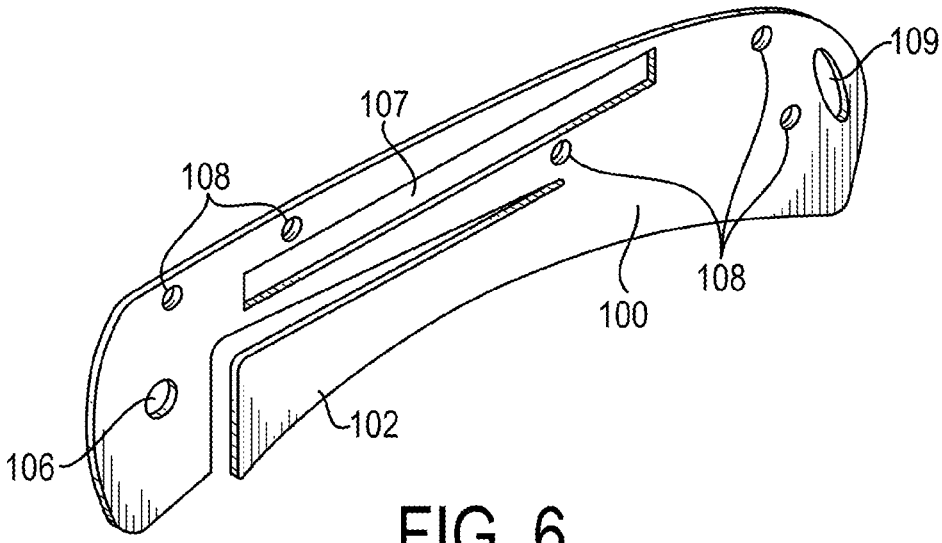
FIG. 6 shows a perspective view of a liner lock according to an embodiment of the invention.

Referring to FIGS. 1 and 6, a lock side liner 100 includes a transfer bar assembly recess 107 and a liner lock 102. Lock side liner 100 also includes a hole 106, a plurality of threaded holes 108, and a lanyard hole 109.

Figure 7A:
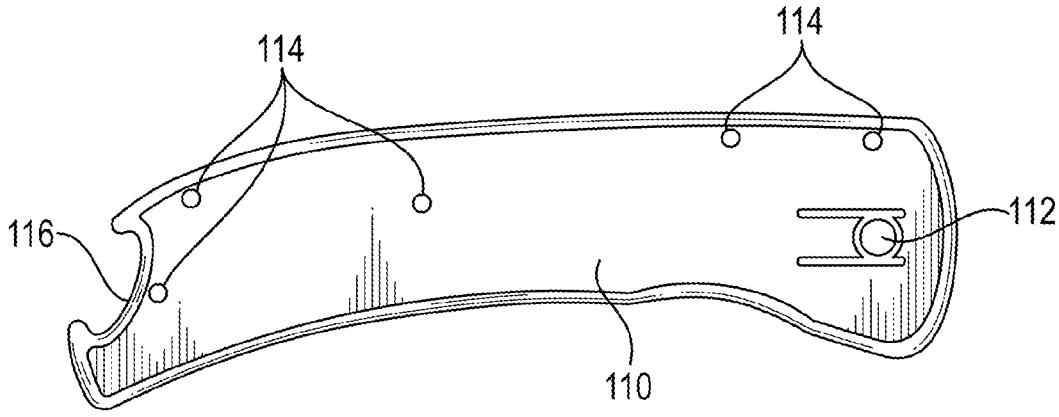
FIG. 7A shows a front elevation view, including stippling, of a file side handle according to an embodiment of the invention.
Figure 7B:
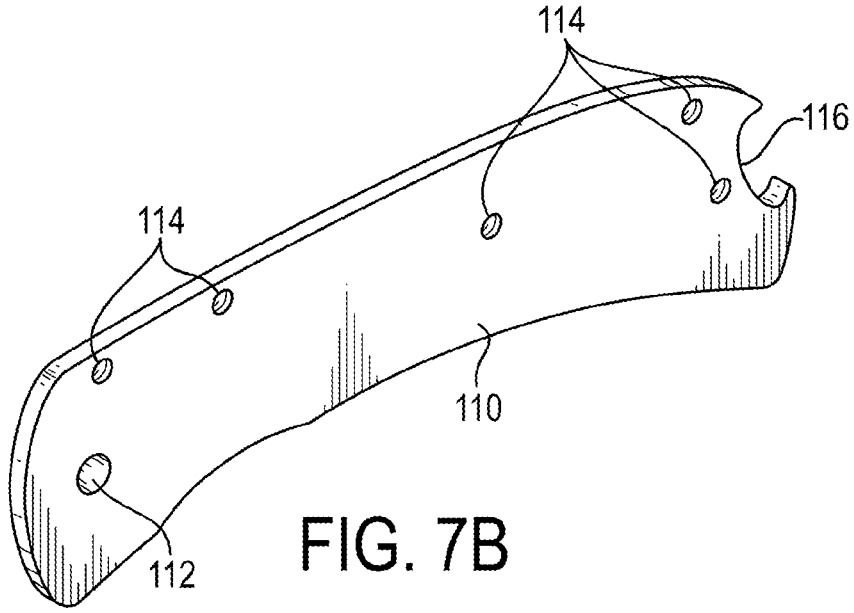
FIG. 7B shows a perspective view of the file side handle of FIG. 7A.

Referring to FIGS. 1 and 7, a file side handle 110 includes a hole 112, a plurality of threaded holes 114, and a lanyard notch 116.

Figure 8A:
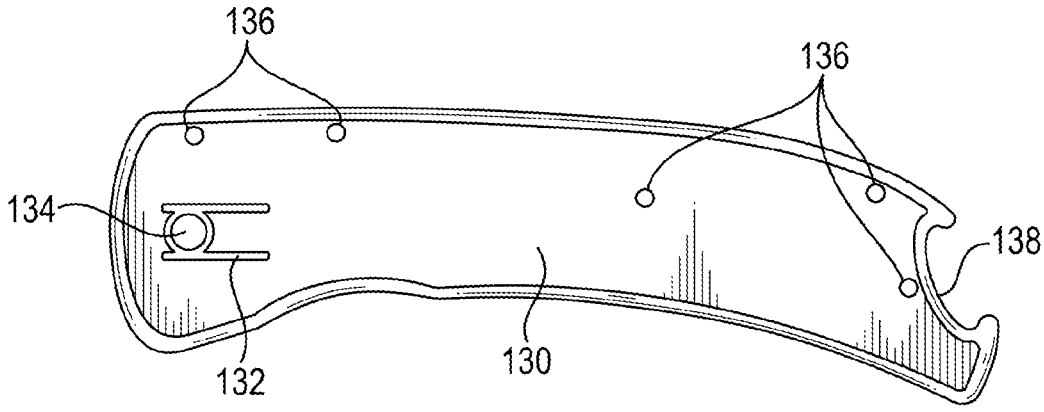
FIG. 8A shows a front elevation view, including stippling, of a mark side handle according to an embodiment of the invention.
Figure 8B:
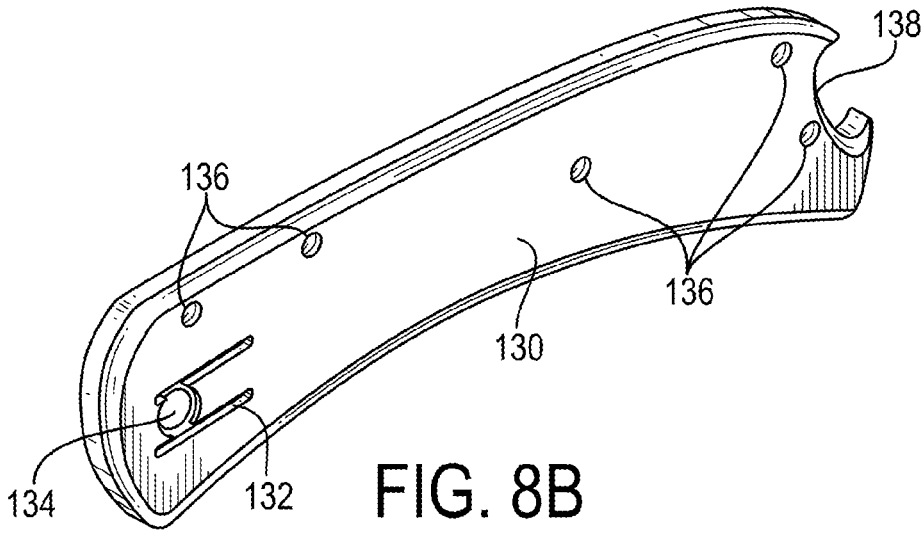
FIG. 8B shows a perspective view of the mark side handle of FIG. 8A.

Referring to FIGS. 1 and 8, a mark side handle 130 includes a hole 134, a plurality of threaded holes 136, a lanyard notch 138, and a belt clip recess 132.

Figure 9A:
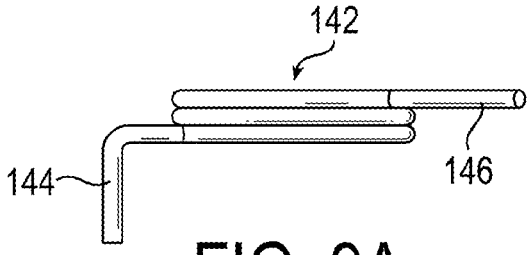
FIG. 9A shows a front elevation view of a blade opener spring according to an embodiment of the invention.
Figure 9B:
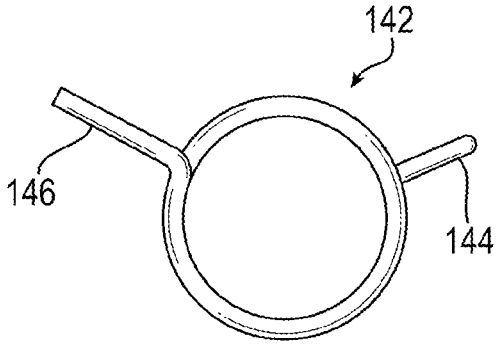
FIG. 9B shows a top view of the blade opener spring of FIG. 9A.
Figure 9C:
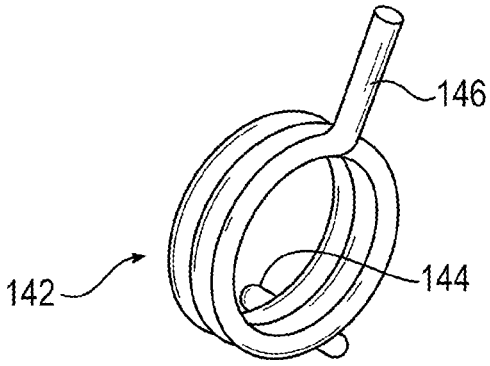
FIG. 9C shows a perspective view of the blade opener spring of FIGS. 9A-9B.

Referring to FIGS. 1 and 9, a blade opener spring 142 is shown, with an end 144 bent orthogonally to a plane running through a circumference of a circular portion of spring 142, and another end 146 bent outward along a radial axis of the circular portion of spring 142. Blade opener spring 142 is a torsion coiled spring, preferably of 0.025 inch diameter music wire.

Figure 10:
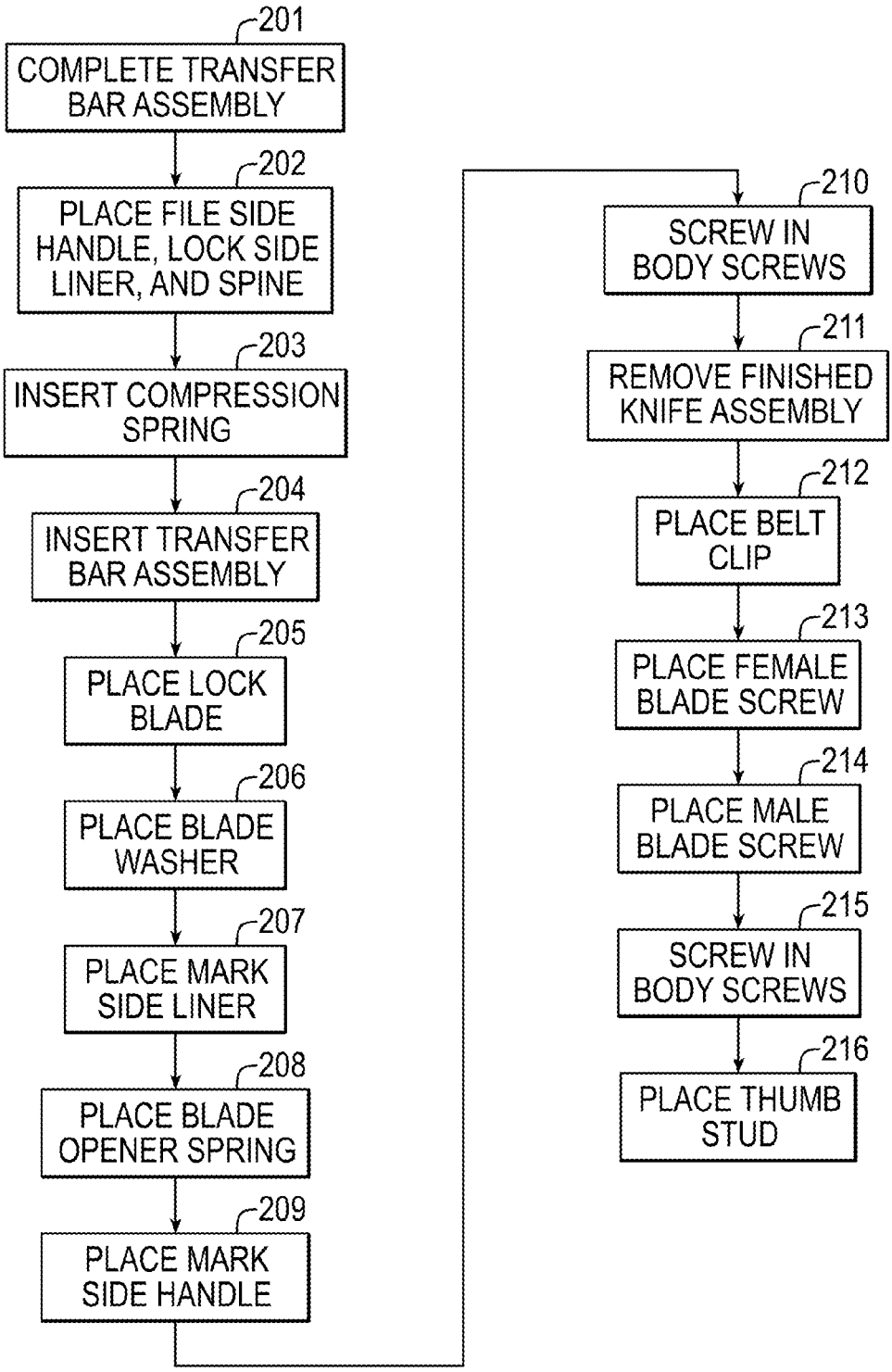
FIG. 10 shows a method of assembly of the folding knife of FIG. 1.

Referring to FIGS. 1 and 10, folding knife 10 is preferably assembled as follows. In step 201, transfer bar assembly 70 is completed by fitting front transfer bar 72 to rear transfer bar 74 by placing hook 84 over bar 82. Leaf spring 76 is placed onto stud 80 of rear transfer bar 74 (FIG. 4) and attached by hot melting stud 80 or riveting. In step 202, file side handle 110 is preferably placed in an assembly fixture (not shown) or held in a person's hand (not shown), after which lock side liner 100 is placed onto file side handle 110, followed by blade washer 44 *a* and spine 50. If using the assembly fixture, the assembly fixture contains a blade assembly guide pin which fits through holes 112, 106, and blade washer 44 *a*. If using one's hand, male blade screw 118 preferably forms this function.

In step 203, a compression spring 148 is inserted into transfer bar assembly recess 52 of spine 50, and in step 204, transfer bar assembly 70 is inserted in the front portion of spine 50 in front of compression spring 148. Compression spring 148 is thus to the rear of transfer bar assembly 70. "Rear" denotes the end of spine 50 which contains lanyard hole 60, while "front" denotes the opposite end.

In step 205, hole 30 of lock blade 20 is placed onto the blade assembly guide pin if using the assembly fixture, or alternatively onto the end of male blade screw 118. Folding knife 10 is preferably assembled with lock blade 20 in the open position. In step 206, blade washer 44*b* is placed onto the blade assembly guide pin if using the assembly fixture, or alternatively onto the end of male blade screw 118.

In step 207, mark side liner 90 is emplaced onto the growing knife assembly. Then, in step 208, a blade opener spring 142 is placed onto the blade assembly guide pin if using the assembly fixture, or alternatively onto the end of male blade screw 118. End 144 must be placed through curved slot 92 into hole 150 of lock blade 20. In step 209, mark side handle 130 is placed onto mark side liner 90.

In step 210, body screws 122 are screwed into corresponding holes 136 on mark side handle 130. In step 211, the finished knife assembly is removed from the assembly fixture if one is being used. In step 212, belt clip 140 is placed into belt clip recess 132, after which female blade screw 120 is inserted into hole 134 in step 213. If the assembly fixture was used to assemble the knife, in step 214 male blade screw 118 is inserted into hole 112 and screwed into the end of female blade screw 120; but if no assembly fixture was used and male blade screw 118 is already within the knife assembly, at this step male blade screw 118 is simply screwed into female blade screw 120.

In step 215, body screws 122 are screwed into corresponding holes 114 in file side handle 110. Finally, in step 216, thumb stud 36 is fastened in place in recess area 32 using thumb stud screw 38.

Folding knife 10 is an assisted opening folding knife. When lock blade 20 is in the closed position, it is biased into the closed position by compression spring 148, with sear 40 engaging transfer bar assembly 70. When opening lock blade 20, once lock blade 20 is moved out approximately 30° and front transfer bar 72 clears sear 40, the action of blade opener spring 142 moves lock blade 20 into the fully open position.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A folding knife, comprising:

a lock blade; and a handle connected to the lock blade;

wherein the handle includes:

a transfer bar assembly biased by a compression spring; and a blade opener spring connected to the lock blade;

such that when the lock blade is in a closed position, the transfer bar assembly biases the lock blade into the closed position, and such that when the lock blade is opened past a certain point, the blade opener spring assists in moving the lock blade into an open position; and wherein the handle further comprises a spline, a lock side liner, and a mark side liner;

wherein the spline includes a spline portion of a transfer bar assembly recess, the lock side liner includes a lock side liner portion of the transfer bar assembly recess, and the mark side liner includes a mark side liner portion of the transfer bar assembly recess; and wherein the transfer bar assembly and the compression spring are both contained in the transfer bar assembly recess.

2. A folding knife according to claim 1, wherein the handle further comprises a file side handle and a mark side handle, wherein the file side handle is adjacent the lock side liner, the lock side liner is adjacent the spline, the spline is adjacent the mark side liner, and the mark side liner is adjacent the mark side handle.

3. A folding knife according to claim 2, wherein the lock blade is pivotally connected to the spline.

4. A folding knife according to claim 3, further comprising a sear on the lock blade which engages the transfer bar assembly when the lock blade is in the closed position.

5. A folding knife according to claim 1, wherein the transfer bar assembly includes a front transfer bar pivotally connected to a rear transfer bar, and a leaf spring connected to the rear transfer bar and positioned such that the leaf spring biases the front transfer bar such that the front transfer bar is axially aligned with the rear transfer bar.

6. A method of manufacturing a folding knife, comprising the steps of:

making a file side handle, a lock side liner, a spline, a mark side liner, a mark side handle, and a lock blade; wherein the lock side liner, the spline, and the mark side liner each contain a transfer bar assembly recess;

making a transfer bar assembly by (a) making a front transfer bar, (b) making a rear transfer bar, (c) making a leaf spring, (d) pivotally connecting the front transfer bar to the rear transfer bar, and (e) connecting the leaf spring to the rear transfer bar such that the leaf spring biases the front transfer bar so that the front transfer bar is axially aligned with the rear transfer bar;

making a compression spring and a blade opener spring; and assembling the folding knife.

7. A method according to claim 6, wherein the step of assembling includes the steps of:

(a) emplacing the file side handle in a stable position;

(b) emplacing the lock side liner onto the file side handle;

(c) emplacing the spline onto the lock side liner;

(d) emplacing the compression spring in a transfer bar assembly recess formed by the respective transfer bar assembly recesses in the lock side liner and the spline;

(e) emplacing the transfer bar assembly in the transfer bar assembly recess longitudinally adjacent the compression spring;

(f) emplacing a first blade washer onto the lock side liner;

(g) emplacing the lock blade, in an open position, onto the first blade washer;

(h) emplacing a second blade washer onto the lock blade;

(i) emplacing the mark side liner onto the spline and the second blade washer;

(j) emplacing the blade opener spring in a curved slot in the mark side liner and inserting an end of the blade opener spring in a corresponding hole in the lock blade;

(k) emplacing the mark side handle onto the mark side liner;

(l) emplacing and fastening a plurality of body screws into a corresponding plurality of threaded body holes in the mark side handle;

(m) emplacing a female blade screw in a blade pin hole in the mark side handle;

(n) emplacing a male blade screw in a blade pin hole in the file side handle;

(o) fastening the male blade screw into the female blade screw; and (p) emplacing and fastening a plurality of body screws into a corresponding plurality of threaded body holes in the file side handle.

8. A method according to claim 7, further comprising the steps of:

(q) before step (m), emplacing a belt clip into the mark side handle;

(r) after step (p), emplacing and fastening a thumb stud into a recessed area on the lock blade (20).

9. A folding knife, comprising:

a lock blade; and a handle connected to the lock blade;

wherein the handle includes:

a transfer bar assembly biased by a compression spring, said transfer bar assembly comprising a rear transfer bar and a front transfer bar pivotally attached to said rear transfer bar and a leaf spring connected to the rear transfer bar and positioned such that the leaf spring biases the front transfer bar such that the front transfer bar is axially aligned with the rear transfer bar; and a blade opener spring connected to the lock blade;

such that when the lock blade is in a closed position, the transfer bar assembly biases the lock blade into the closed position, and such that when the lock blade is opened past a certain point, the blade opener spring assists in moving the lock blade into an open position.

10. A folding knife according to claim 9, wherein the leaf spring biases the pivoted connection between the front transfer bar and the rear transfer bar.

11. A folding knife according to claim 10, wherein the leaf spring biases the pivoted connection between the front transfer bar and the rear transfer bar in the straight position.

12. A folding knife according to claim 10, wherein the leaf spring is connected to both the front transfer bar and the rear transfer bar.

* * * * *